US008050582B2

(12) United States Patent
Aiba

(10) Patent No.: US 8,050,582 B2
(45) Date of Patent: Nov. 1, 2011

(54) IMAGE FORMING APPARATUS

(75) Inventor: Shozo Aiba, Ushiku (JP)

(73) Assignee: Canon Kabushiki Kaisha, Tokyo (JP)

( * ) Notice: Subject to any disclaimer, the term of this patent is extended or adjusted under 35 U.S.C. 154(b) by 483 days.

(21) Appl. No.: 12/328,958

(22) Filed: Dec. 5, 2008

(65) Prior Publication Data

US 2009/0148202 A1 Jun. 11, 2009

(30) Foreign Application Priority Data

Dec. 7, 2007 (JP) ..... 2007-316495

(51) Int. Cl.
*G03G 15/16* (2006.01)

(52) U.S. Cl. ..... 399/66; 399/297

(58) Field of Classification Search ..... 399/66, 399/297–319
See application file for complete search history.

(56) References Cited

U.S. PATENT DOCUMENTS

| | | | | |
|---|---|---|---|---|
| 6,198,899 | B1 | 3/2001 | Takahashi et al. | 399/303 |
| 6,324,374 | B1 | 11/2001 | Sasamoto et al. | 399/298 |
| 6,556,802 | B2 | 4/2003 | Sasamoto et al. | 399/299 |
| 6,768,891 | B2 | 7/2004 | Sasamoto et al. | 399/228 |
| 6,799,010 | B2 | 9/2004 | Namiki | 399/298 |
| 6,941,102 | B2 | 9/2005 | Sasamoto et al. | 399/299 |
| 6,957,033 | B2 | 10/2005 | Saito et al. | 399/302 |
| 7,054,585 | B2 | 5/2006 | Sasamoto et al. | 399/299 |
| 2008/0095556 | A1* | 4/2008 | Mochizuki | 399/308 |

FOREIGN PATENT DOCUMENTS

| | | |
|---|---|---|
| JP | 2000-181184 | 6/2000 |
| JP | 2001-209234 | 8/2001 |
| JP | 2001-242680 | 9/2001 |
| JP | 2002-91128 | 3/2002 |
| JP | 2003-43770 | 2/2003 |
| JP | 2004-118114 | 4/2004 |

* cited by examiner

*Primary Examiner* — David Gray
*Assistant Examiner* — G.M. Hyder
(74) *Attorney, Agent, or Firm* — Fitzpatrick, Cella, Harper & Scinto

(57) ABSTRACT

In a black monochromatic mode, an intermediary transfer belt is separated from an upstream photosensitive drum in a state in which a downstream photosensitive drum contacts the intermediary transfer belt. At this time, a stretching roller is moved upwardly in interrelation with a contact-separation mechanism to increase an angle of contact of the intermediary transfer belt with the downstream photosensitive drum compared with the case of a full-color mode. On the other hand, in the full-color mode, the stretching roller is moved downwardly to be separated from an inner surface of the intermediary transfer belt.

16 Claims, 10 Drawing Sheets

IMAGE FORMING APPARATUS

FIELD OF THE INVENTION AND RELATED ART

The present invention relates to an image forming apparatus capable of executing a full-color mode and a black monochromatic mode.

A tandem type image forming apparatus in which a plurality of image bearing members different in development color is arranged along a rotation path of a belt member (an intermediary transfer belt or a recording material conveying belt) and a full-color image is formed has been put into practical use.

In such an image forming apparatus, a first mode (e.g., a full-color mode) and a second mode (e.g., a monochromatic mode) is switchably executable and in the second mode, a photosensitive drum as an image bearing member for development color which is not subjected to operation is separated from a transfer belt. This image forming apparatus has been put into practical use.

Japanese Laid-Open Patent Application (JP-A) 2003-043770 discloses an image forming apparatus in which image forming stations for yellow, magenta, cyan and black as development color are arranged from an upstream side along an intermediary transfer belt. In the image forming apparatus, when a black monochromatic mode is set, unused ones of image forming stations for yellow, magenta, cyan and black are moved obliquely upwardly, so that associated photosensitive drums are separated from the intermediary transfer belt.

Further, as a constitution for moving the intermediary transfer belt, JP-A 2001-242680 discloses an image forming apparatus in which a black image forming station is disposed on a downstream side of the intermediary transfer belt with respect to a rotational direction of the intermediary transfer belt and cyan, magenta and yellow image forming stations are disposed upstream of the black image forming station. In the image forming apparatus, a supporting roller is disposed between the black image forming station and the cyan image forming station to support a surface of the intermediary transfer belt opposite from a surface of the intermediary transfer belt facing the photosensitive drums. Then, an upstream portion of the intermediary transfer belt located upstream of the supporting roller is rotationally moved downwardly with the supporting roller as a center (supporting point), so that photosensitive drums for yellow, magenta and cyan are separated from the intermediary transfer belt. In this constitution, with respect to the black photosensitive drum, the belt member is moved so that a contact area between the photosensitive drum and the intermediary transfer belt in a color mode is equal to that in a black mode.

JP-A 2000-181184 discloses an image forming apparatus in which photosensitive drums for yellow, magenta, cyan and black as development color are arranged from an upstream side along a recording material conveying belt. In this image forming apparatus, with the black photosensitive drum as a center, the entire recording material conveying member unit is rotationally moved, so that the photosensitive drums for yellow, magenta, cyan and black are separated from the recording material conveying belt. That is, a transfer roller is moved and at the same time an attitude of the recording material conveying belt is changed.

JP-A 2001-209234 discloses an image forming apparatus in which stretching rollers are disposed at an inner surface of a recording material conveying belt for conveying a recording material between image forming stations so that the stretching rollers support the recording material conveying belt so as to be wound about photosensitive drums. In this image forming apparatus, the stretching rollers are moved upwardly and downwardly to control contact and separation between the recording material conveying belt and the photosensitive drums. That is, in a color mode, a belt surface located upstream of the photosensitive drum with respect to a rotational direction of the recording material conveying belt is moved toward the photosensitive drum more than that in a black mode. On the other hand, with respect to a downstream-side belt surface, the belt surface in the color mode is separated from the photosensitive drum more than that in the black mode.

As described above, various constitutions for changing an attitude of the belt in the monochromatic mode have been conventionally proposed.

Incidentally, when toner is transferred from the photosensitive drum onto the intermediary transfer belt or the recording material on the transfer belt, it has been known that different problems occur depending on a position of a transfer member for forming a transfer portion at which the toner on the photosensitive drum is transferred.

Generally, it is desirable that the toner on the photosensitive drum is transferred in an area (contact area) in which the toner contacts the belt member. However, when the transfer member is shifted toward an upstream side of the belt member with respect to the rotational direction of the belt member, a part of the toner on the photosensitive drum is transferred before the toner reaches the contact area due to discharge caused by a minute gap. When this transfer is carried out, an image defect such that the toner is scattered on the intermediary transfer belt or the recording material (a scattering problem) occurs. In order to prevent this image defect, when the transfer member is shifted toward a downstream side of the belt member with respect to the rotational direction of the belt member, it is possible to decrease a voltage at a minute gap portion. Therefore, the discharge can be suppressed and such an image defect can be prevented.

However, when the transfer member is disposed on the downstream side, the following problem has arisen.

As shown in FIG. 10, when the transfer member is disposed on the downstream side, the contact area is increased. As a result, the toner which has already been transferred from the upstream-side image forming stations to the intermediary transfer belt is electrically charged to a polarity opposite to a normal charge polarity of the toner due to minute discharge. Thus, a problem that the toner electrically charged to the opposite polarity in the contact area is deposited on the photosensitive drum (a re-transfer problem) has arisen (FIG. 11).

The positioning of the transfer member is set in view of these problems so that the respective problems described above are inconspicuous.

In the case of the black monochromatic mode, image formation at color image forming stations is not carried out and therefore there is less concern about the above-described re-transfer problem, so that a constitution for reducing a degree of the scattering problem may preferably be employed.

As an example thereof, JP-A 2002-91128 discloses a constitution in which a position of a transfer roller with respect to a photosensitive drum is changed in a state in which an amount of contact of an intermediary transfer belt with the photosensitive drum is constant in both of the black monochromatic mode and the full-color mode.

However, in the constitution in which the position of the transfer roller is changed as described in JP-A 2002-91128, stability of the transfer roller position is lowered. For that reason, a constitution capable of reducing a degree of the scattering problem in the monochromatic mode without moving the transfer member has been desired.

SUMMARY OF THE INVENTION

A principal object of the present invention is to improve a quality of an image formed in a monochromatic mode with a simple constitution.

According to an aspect of the present invention, there is provided an image forming apparatus comprising:

a first image bearing member;

a second image bearing member;

a rotatable belt member, contactable to the first image bearing member and to the second image bearing member, for carrying a toner image, wherein the first image bearing member is disposed downstream of the second image bearing member with respect to a rotational direction of the belt member;

a first transfer member for transferring a toner image from the first image bearing member onto the belt member;

a second transfer member for transferring a toner image from the second image bearing member onto the belt member;

a movable portion for separating the belt member from the second image bearing member in a state in which the first image bearing member and the belt member contact each other; and a belt surface moving portion for moving a surface of the belt member between the first image bearing member and the second image bearing member so that a contact area between the first image bearing member and the belt member when the belt member and the second image bearing member are separated from each other is larger than that when the first image bearing member and the second image bearing member contact the belt member.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinbelow, several embodiments of the present invention will be described in detail with a reference to the drawings.

The present invention can be carried out in not only an image forming apparatus using an intermediary transfer belt but also an image forming apparatus for transferring a toner image onto a recording material carried on a recording material conveying belt. Further, it is also possible to carry out the present invention in not only a tandem type image forming apparatus in which a plurality of photosensitive drums is arranged along a belt member but also one drum type image forming apparatus in which a single photosensitive drum is disposed.

In this embodiment, only principal portion regarding formation/transfer of the toner images will be described but the present invention can be carried out in various uses such as a printer, various printing machines, a copying machine, a facsimile machine, a multi-function machine by adding necessary device, equipment and housing structure.

First Embodiment

Figure 1:
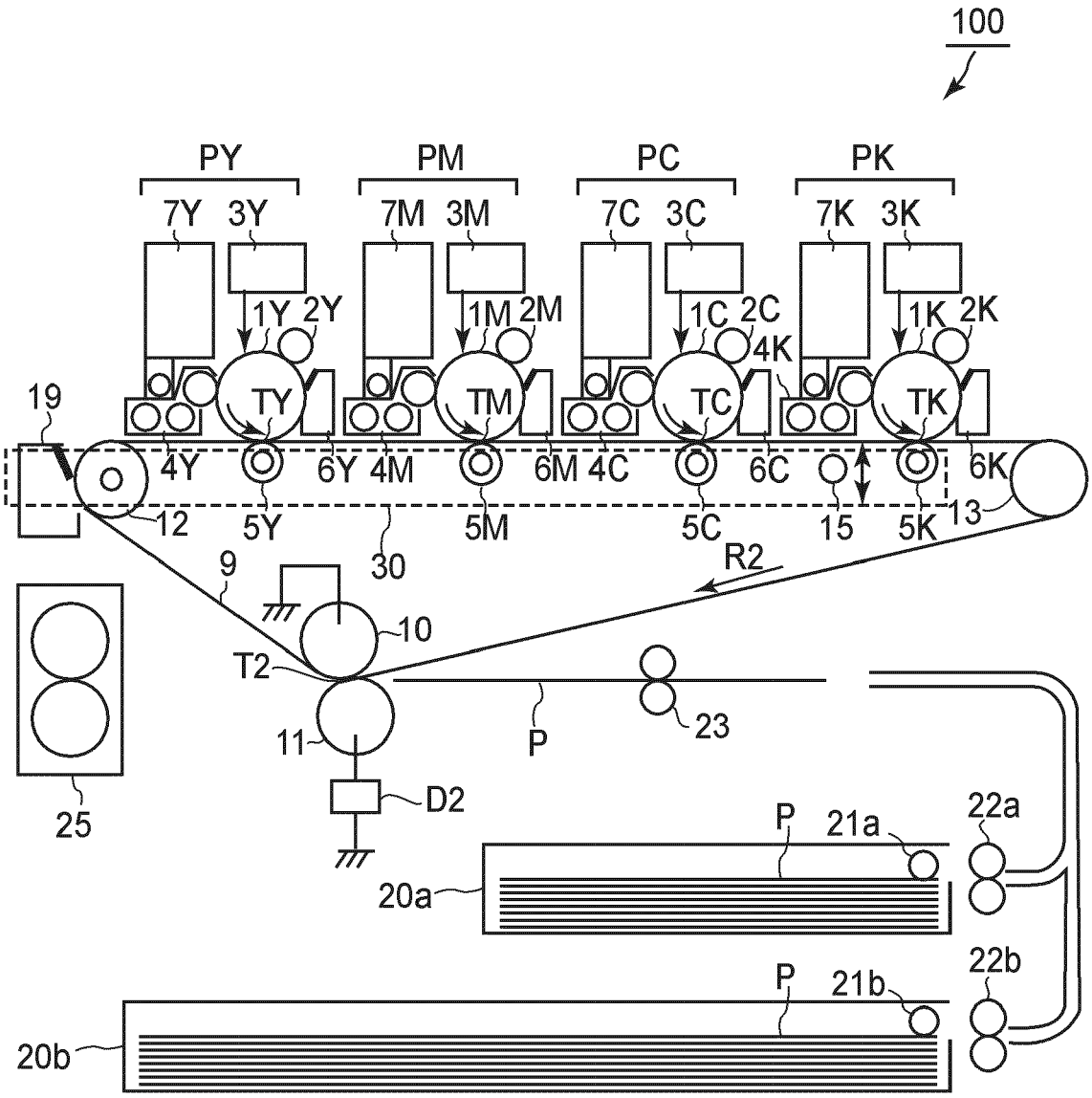
FIG. 1 is a schematic view for illustrating a constitution of an image forming apparatus of First Embodiment.
Figure 2:
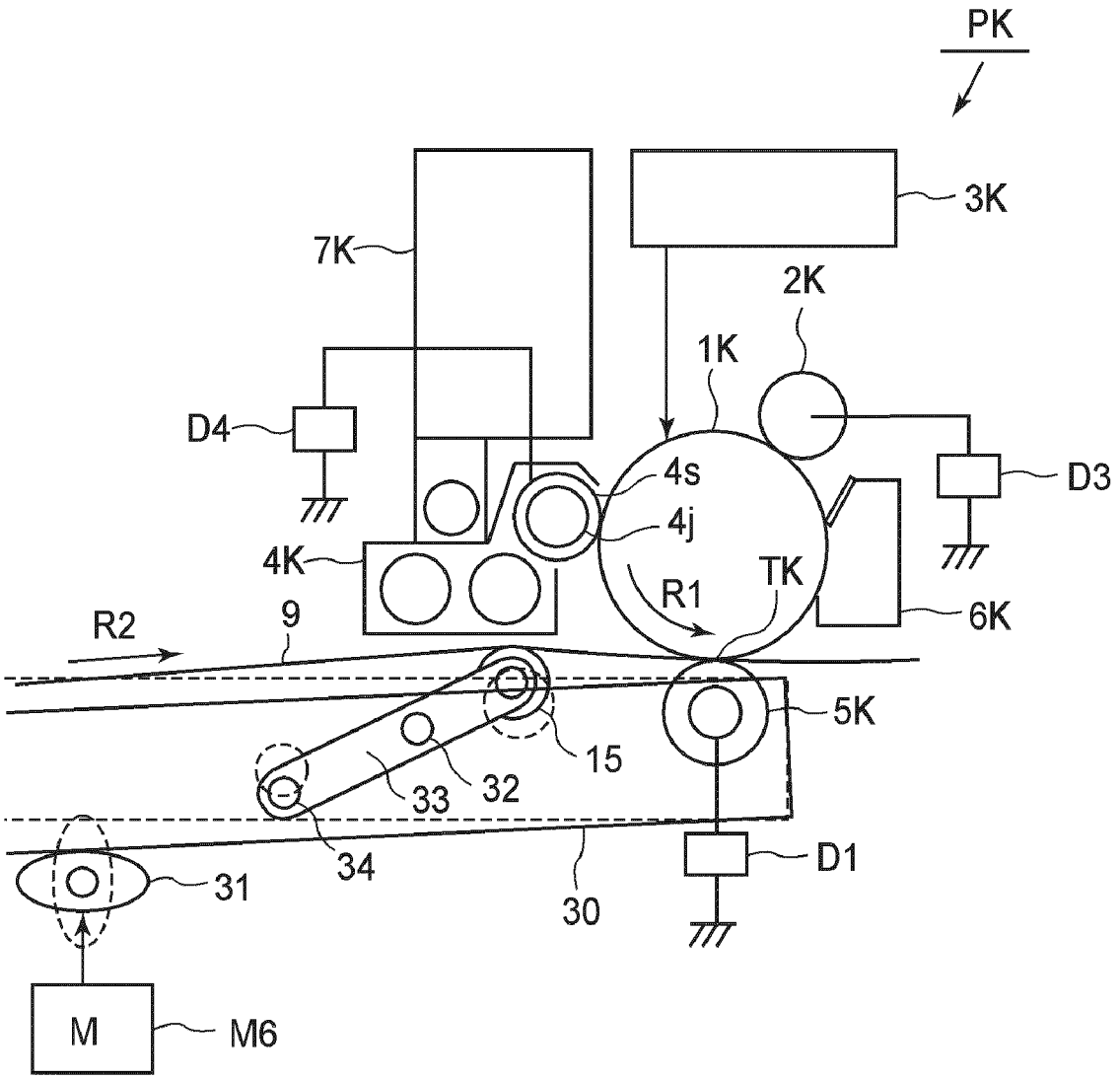
FIG. 2 is a schematic view for illustrating a constitution of an image forming station.
Figure 3:
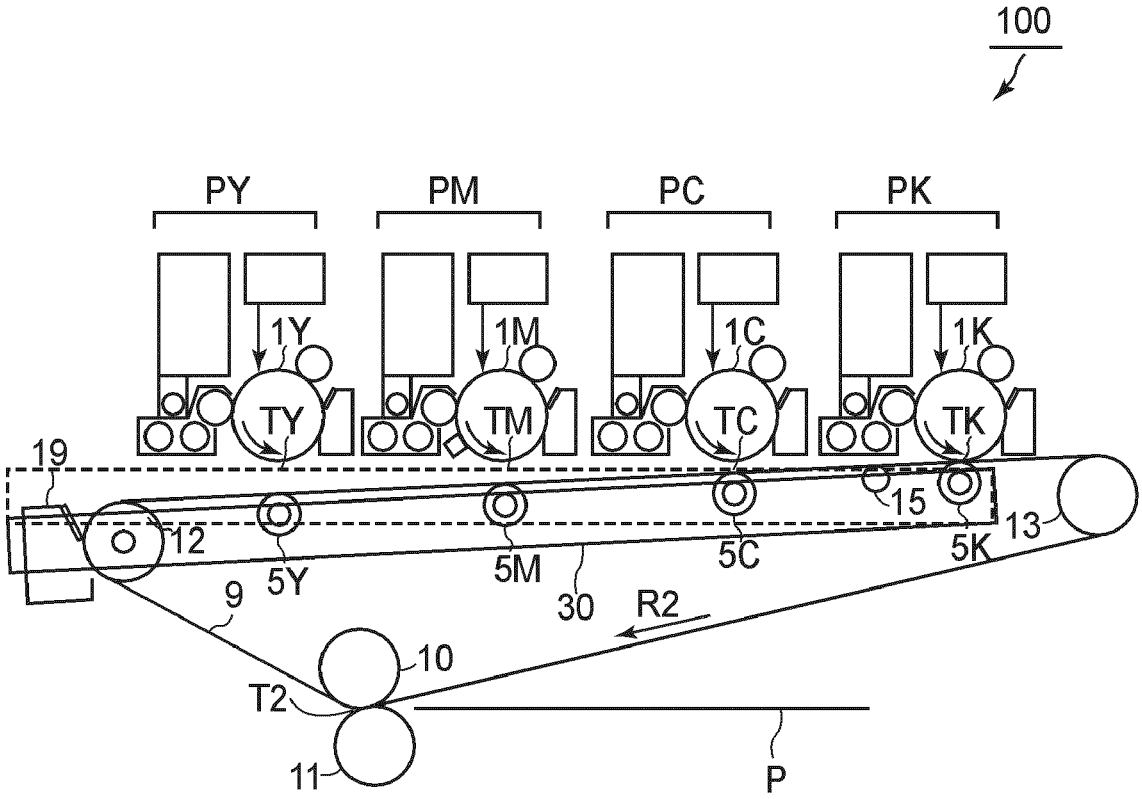
FIG. 3 is a schematic view for illustrating a black monochromatic mode.

FIG. 1 is a schematic view for illustrating a constitution of an image forming apparatus of First Embodiment, FIG. 2 is a schematic view for illustrating a constitution of an image forming station, and FIG. 3 is a schematic view for illustrating a black monochromatic mode.

As shown in FIG. 1, an image forming apparatus 100 of First Embodiment is a tandem type full-color laser beam printer of an intermediary transfer type in which image forming stations PY, PM, PC and PK for yellow, cyan, magenta and black are disposed along an intermediary transfer belt 9 as a belt member.

At the image forming station PY, a yellow toner image is formed on a photosensitive drum 1Y and is electrostatically primary-transferred onto the intermediary transfer belt 9. At the image forming station PM, a magenta toner image is formed on a photosensitive drum 1M and is electrostatically primary-transferred onto the intermediary transfer belt 9 while being superposed on the yellow toner image. At image forming stations PC and PK, a cyan toner image and a black toner image are formed on a photosensitive drum 1C and a photosensitive drum 1K, respectively, and are electrostatically primary-transferred onto the intermediary transfer belt 9 while being superposed on the yellow and magenta toner images.

The four color toner images carried on the intermediary transfer belt 9 are conveyed to a secondary transfer portion T2, at which the toner images are secondary-transferred collectively onto a recording material P. The recording material P is drawn from a sheet feeding cassette 20*a* (20*b*) by a sheet feeding roller 21*a* (21*b*) and separated one by one by a separating device 22*a* (22*b*) to be fed to registration rollers 23.

The registration rollers 23 feed the recording material P to the secondary transfer portion T2 so that a leading end of the recording material P coincides with the toner images on the intermediary transfer belt 9.

The recording material P onto which the four color toner images are secondary-transferred is delivered to a fixing device 25 and is subjected to heat pressing, so that a full-color image is fixed on a surface of the recording material P.

A belt cleaning device 19 removes transfer residual toner which passed through a secondary transfer portion T2 and remains on the intermediary transfer belt 9.

The image forming stations PY, PM, PC and PK are constituted similar to each other except that the colors of toners used in developing devices 4Y, 4M, 4C and 4K provided in the image forming stations are yellow, magenta, cyan and black, i.e., different from each other.

Therefore, in the following, only the image forming station PK for black will be described and other image forming stations PY, PM and PC should be understood that constituent members thereof are collectively described by replacing the suffix K of reference numerals for associated constituent members with Y, M and C.

As shown in FIG. 2, at the image forming station PK as a first image forming station, a charging device 2K, an exposure device 3K, a developing device 4K, a primary transfer roller 5K and a cleaning device 6K are disposed around the photosensitive drum 1K as a first image bearing member.

The photosensitive drum 1K is constituted by applying an organic photoconductor (OPC) layer, as a photosensitive layer, having an outer diameter of 30 mm onto a cylindrical surface of an aluminum cylinder and is rotated in a direction of an arrow R1.

When an organic photosensitive member layer or an amorphous silicon photosensitive member layer which has a resistivity of $10^9$ to $10^{14}$ ohm.cm is used in the photosensitive drum 1, electric charge injection charging can be realized and the use of the photosensitive member layer is effective in prevention of an occurrence of ozone, reduction in electric energy consumption, and improvement in charging property. In First Embodiment, a negatively chargeable organic photosensitive member is used and is prepared by providing, on a drum support formed of aluminum in an outer diameter of 30 mm, the following first to fifth layers successively in ascending order from a lowermost layer located on the drum support.

The first layer is an undercoating layer consisting of a 20 μm-thick electroconductive layer and levels a defective surface or the like of the aluminum support.

The second layer is a positive charge injection preventing layer consisting of 1 μm-thick medium-resistance layer and prevents a positive charge injected from the support from cancelling a negative charge present on the surface of the photosensitive member. The second layer is adjusted in resistance so as to be approximately $10\times10^6$ ohm.cm by alamine resin and methoxymethylated nylon.

The third layer is an about 0.3 μm-thick charge generation layer of a resin material in which a diazo pigment is dispersed and generates a charge pair of positive and negative charges by being subjected to light exposure.

The fourth layer is a charge transport layer formed of a p-type semiconductor by dispersing hydrazone in polycarbonate resin. The negative charge present at the surface of the photosensitive drum 1K cannot move in the fourth layer, so that only the positive charge generated in the charge generation layer can be transported to the photosensitive member surface.

The fifth layer is a charge injection layer formed by applying onto the fourth layer a material consisting of a binder of an insulating resin in which $SnO_2$ ultrafine particles are dispersed. Specifically, the fifth layer is a coating layer of a material prepared by dispersing 70 wt. % of $SnO_2$ particles having a particle size of 0.03 μm in an insulating resin lowered in resistance (made electroconductive) layer being doped with antimony as a light-transmissive insulating filler. The prepared coating liquid is applied onto the fourth layer in a thickness of about 3 μm by an appropriate coating method such as dipping, spray coating, roll coating or beam coating to form the charge injection layer.

The charging device 2K electrically charges the surface of the photosensitive drum 1K to a uniform negative potential by causing a charging roller supplied with a voltage in the form of a negative DC voltage biased with an AC voltage from a power source D3 to contact and rotate the photosensitive drum 1K.

The exposure device 3K scans the surface of the photosensitive drum 1K, through a rotatable mirror, with a laser beam obtained by ON-OFF modulation of scanning line image data expanded from a color-separated black component image. By this scanning, an electrostatic image is written (formed) on the surface of the charged photosensitive drum 1K.

The developing device 4K electrically charges toner to a negative polarity by stirring two component developer comprising a mixture of the toner and a magnetic carrier. The charged toner is carried in an erected chain state on a developing sleeve 4*s* rotating around a fixed magnetic pole 4*j* in a direction counter to the rotation of the photosensitive drum 1K, thus rubbing the photosensitive drum 1K. A toner supply container 7K supplies toner to the developing device 4K.

A power source D4 applies a voltage in the form of a negative DC voltage biased with an AC to the developing sleeve 4*s*, so that the toner is deposited on the electrostatic image, on the photosensitive drum 1K, which is positive in polarity relative to the developing sleeve 4*s* to reversely develop the electrostatic image.

In this embodiment, the photosensitive drum 1K of the image forming station PK is used as the first image bearing member and the photosensitive drum 1C of the image forming station PC is used as the second image bearing member.

<Transfer Member>

The primary transfer roller 5K as a first transfer member nips the intermediary transfer belt 9 between it and the photosensitive drum 1K to form a primary transfer portion TK between the photosensitive drum 1K and the intermediary transfer belt 9.

The primary transfer roller 5K includes an electroconductive cylindrical metal shaft having a diameter of 8 mm and an electroconductive foamed member which has a resistance of $5.0\times10^6$ ohm.cm and a thickness of 1.0 mm and is disposed on a peripheral surface of the metal shaft.

The primary transfer roller 5K has a weight of 300 g and pressed upwardly in a vertical direction by springs (total pressure: 5 KPa) at both end portions thereof to press the intermediary transfer belt 9 against the surface of the photosensitive drum 1K.

A position of the primary transfer roller 5K is shifted toward a downstream side of the vertical direction of the center shaft of the photosensitive drum 1K with respect to the rotational direction of the intermediary transfer belt 9 by 1.5 mm.

A power source D1 applies a positive DC voltage to the primary transfer roller 5K to transfer the negatively charged toner carried on the photosensitive drum 1K onto the intermediary transfer belt 9 passing through the primary transfer portion TK.

The cleaning device 6K rubs the photosensitive drum 1K with a cleaning blade to remove the transfer residual toner which passed through the primary transfer portion TK and remains on the surface of the photosensitive drum 1K.

Further, in this embodiment, as a second transfer member, a primary transfer roller 5C is provided. As other transfer members, primary transfer rollers 5M and 5Y are provided.

<Transfer Belt>

The intermediary transfer belt 9 is extended around and supported by a driving roller 13, a tension roller 12, an opposing roller 10, and the primary transfer rollers 5Y, 5M, 5C and 5K and is rotated in an arrow R2 direction by the driving roller 13. The driving roller 13 is prepared by forming an electroconductive rubber layer adjusted to have a resistance of $1\times10^3$ ohm to $1\times10^5$ ohm on a metal core which is grounded.

The intermediary transfer belt 9 includes a 85 μm-thick polyimide resin film as a base material and is adjusted in resistance so as to have a surface resistivity of $1\times10^{12}$ ohm/□ and a volume resistivity of $1\times10^9$ ohm.cm by dispersing carbon black in the base material. A rotational speed (process speed) of the intermediary transfer belt 9 is 200 mm/sec and that of the photosensitive drum 1K is also 200 mm/sec.

A secondary transfer roller 11 presses the intermediary transfer belt 9 against the opposing roller 10 to form the secondary transfer portion T2 between the intermediary transfer belt 9 and the secondary transfer roller 11.

At the secondary transfer portion T2, the toner images are secondary-transferred from the intermediary transfer belt 9 onto the recording material P in a process in which the recording material P is nipped and conveyed in superposition with the toner images on the intermediary transfer belt 9 and passes through the secondary transfer portion T2.

A power source D2 applies a positive DC voltage to the secondary transfer roller 11 to secondary-transfer the negatively charged toner image carried by the intermediary transfer belt 9 onto the recording material P.

As shown in FIG. 1, the image forming apparatus 100 carries out full-color mode image formation in a state in which a contact-separation mechanism 30 brings the intermediary transfer belt 9 into contact with the photosensitive drums 1Y, 1M and 1C.

As shown in FIG. 3, the image forming apparatus 100 carries out black monochromatic mode image formation in a state in which the contact-separation mechanism 30 separates the intermediary transfer belt 9 from the photosensitive drums 1Y, 1M and 1C.

In the black monochromatic mode, the contact-separation mechanism 30 separates the intermediary transfer belt 9 from the photosensitive drums 1Y, 1M and 1C for unused development colors. This is because when the photosensitive drums 1Y, 1M and 1C which are not subjected to image formation are driven, lifetimes of the cleaning devices (6Y, 6M, 6C: FIG. 1) and the photosensitive drums 1Y, 1M and 1C are shortened.

That is, in the image forming apparatus of the tandem type intermediary transfer type, the plurality of photosensitive drums contacts the intermediary transfer belt at the respective primary transfer portions, so that both members are gradually abraded or deteriorated in surface characteristic at the respective contact positions due to friction or contact pressure. A representative factor of the abrasion (wearing) or the deterioration in surface characteristic may include a frictional force by generation of a difference in conveying speed between the photosensitive drum and the intermediary transfer member.

Further, for the purpose of enhancing a transfer efficiency of the toner image, there is the case where several % of the conveying speed difference is set between the photosensitive drum and the intermediary transfer belt but in this case, a scraped amount of the photosensitive drum is remarkably increased.

Further, even when the conveying speed difference is set between the photosensitive drum and the intermediary transfer belt, the conveying speed difference is actually caused during the image formation, thus directly contributing to the surface layer abrasion of the photosensitive drum.

In the case where the peripheral speeds of the photosensitive drum and the intermediary transfer belt are different from each other, the scraped amount of the surface layer of the photosensitive drum is remarkably increased to shorten the lifetime of the photosensitive drum.

The abrasion, the deterioration in surface characteristic, and the increase in scraped amount are unavoidable in the case where the toner image formed on the photosensitive drum is primary-transferred onto the intermediary transfer belt but is not unavoidable with respect to the photosensitive drum on which the toner image to be primary-transferred onto the intermediary transfer belt is not formed.

For example, in the black monochromatic mode, the photosensitive drums for cyan, magenta and yellow as the development color have no influence on the image formation even when the photosensitive drums are separated from the intermediary transfer belt.

For example, in a color mode in which a light cyan toner and a light magenta toner are not used, the photosensitive drums for the light cyan and the light magenta as the development color have no influence on the image formation even when the photosensitive drums are separated from the intermediary transfer belt.

For example, in an image forming mode in which a white toner and a transparent toner are not used, the photosensitive drums for white and transparent have no influence on the image formation even when the photosensitive drums are separated from the intermediary transfer belt.

The toner functions as a buffer material and a lubricant between the photosensitive drum and the intermediary transfer belt, so that the photosensitive drum on which the toner image is not formed is higher in the degree of abrasion and damage and in a deterioration speed of the surface characteristic (property) than the photosensitive drum on which the toner image is formed.

In First Embodiment, the contact-separation mechanism (30) as the movable portion causes the first image bearing member (1Y, 1M, 1C) to contact or be separated from the transfer belt (9).

In the color mode, image formation using a first toner image and a second toner image is effected in a state in which the contact-separation mechanism (30) causes the first image bearing member (1Y, 1M, 1C) to contact the transfer belt (9).

In the monochromatic mode, image formation using the second toner image is effected in a state in which the contact-separation mechanism (30) causes the first image bearing member (1Y, 1M, 1C) to be separated from the transfer belt (9).

<Contact-Separation Member>

As shown in FIG. 2, the contact-separation mechanism 30 is vertically moved rotationally from a broken-line position to a solid-line position with a rotation shaft of the primary transfer roller 5K by rotation of a cam 31 driven by a driving motor M6.

A pair of contact-separation mechanisms 30 is disposed so as to sandwich the intermediary transfer belt 9 with respect to a widthwise direction of the intermediary transfer belt 9 and integrally moves upwardly and downwardly the tension roller 12, a belt cleaning device 19, and the primary transfer rollers 5Y, 5M and 5C.

The contact-separation mechanism 30 bends the intermediary transfer belt 9 by the stretching roller 15 as the contact-separation member and moved downwardly the intermediary transfer belt 9 at a portion upstream of the stretching roller 15, thus separating the intermediary transfer belt 9 from the photosensitive drums 1Y, 1M and 1C. That is, the stretching roller 15 as the contact-separation member for the belt surface moving portion moves the belt surface on an upstream side of the photosensitive drum 1K with respect to the rotational direction of the intermediary transfer belt 9.

At an inner surface of the intermediary transfer belt 9 between the photosensitive drum 1C and the photosensitive drum 1K, the stretching roller 15 formed of aluminum and having a resistance of $1.0\times10^{1}$ ohm is disposed and connected to ground potential.

When the stretching roller 15 has a resistance of $1.0\times10^{1}$ ohm, the toner image carried on the intermediary transfer belt 9 is disturbed in some cases. This is because in the case where high-speed and continuous image formation is effected, the stretching roller 15 is excessively charged electrically to cause electric discharge between the stretching roller 15 and the intermediary transfer belt 9. For this reason, the stretching roller 15 may preferably have an electric resistance of $1.0\times10^{9}$ ohm or less.

The stretching roller 15 is disposed and superposed on the contact-separation mechanism 30 and is rotatably supported at an end of a lever 33 which rotates about a fulcrum (supporting point) 32 fixed to a main assembly frame of the image forming apparatus (100 in FIG. 1).

The other end of the lever 33 rotatably holds a pin 34 fixed to the contact-separation mechanism 30. For this reason, when the contact-separation mechanism 30 is rotationally moved to move the pin 34 upwardly and downwardly, the lever 33 is rotated about the fulcrum 32 to move the stretching roller 15 upwardly and downwardly.

Therefore, the stretching roller 15 is moved upwardly and downwardly in interrelation with the rotational movement of the contact-separation mechanism 30 and is separated from the inner surface of the intermediary transfer belt 9 in the full-color mode.

On the other hand, in the black monochromatic mode, the stretching roller 15 pushes the intermediary transfer belt 9 up to a position higher than that in the full-color mode to bring a portion of the intermediary transfer belt 9 located upstream of the primary transfer portion TK into intimately contact with the photosensitive drum 1K. That is, the amount of contact (winding) of the intermediary transfer belt 9 with (about) the intermediary transfer belt 9 in the black monochromatic mode is made larger than that in the full-color mode.

In the black monochromatic mode, only the toner image formed on the photosensitive drum 1K is transferred onto the intermediary transfer belt (9). At this time, the contact-separation mechanism (30) separates the photosensitive drum 1C and the intermediary transfer belt 9 from each other in a state in which the transfer portion TK is formed. The stretching member (15) raises the transfer belt (9) toward the photosensitive drum 1C between the first transfer portion (TC) and the second transfer portion (TK) in cooperation with the contact-separation mechanism (30) during the separation by the contact-separation mechanism 30. The belt surface moving portion (33) move the stretching member (15). A stretching position in which the stretching member (15) contacts the transfer belt (9) during the separation by the contact-separation mechanism (30) is located on the photosensitive drum (1C) side rather than the intermediary transfer belt 9 when the photosensitive drum (1C) and the intermediary transfer belt (9) are separated from each other.

The stretching member (15) is formed of an electroconductive material and is connected to ground potential and contacts the inner surface of the intermediary transfer belt (9) between the first image bearing member (1Y, 1M, 1C) and the second image bearing member (1K).

The stretching member (15) is capable of setting an angle of contact (winding) of the intermediary transfer belt 9 with (about) the photosensitive drum at a predetermined value.

A control portion (controller) (110) controls the belt moving portion in interrelation with the contact-separation mechanism (30) for causing the intermediary transfer belt (9) to contact and be separated from the first image bearing member (1Y, 1M, 1C). Further, the control portion (110) also functions as a selecting portion for selecting the full-color mode and the black monochromatic mode.

<Control of Contact-Separation Mechanism>

Figure 4:
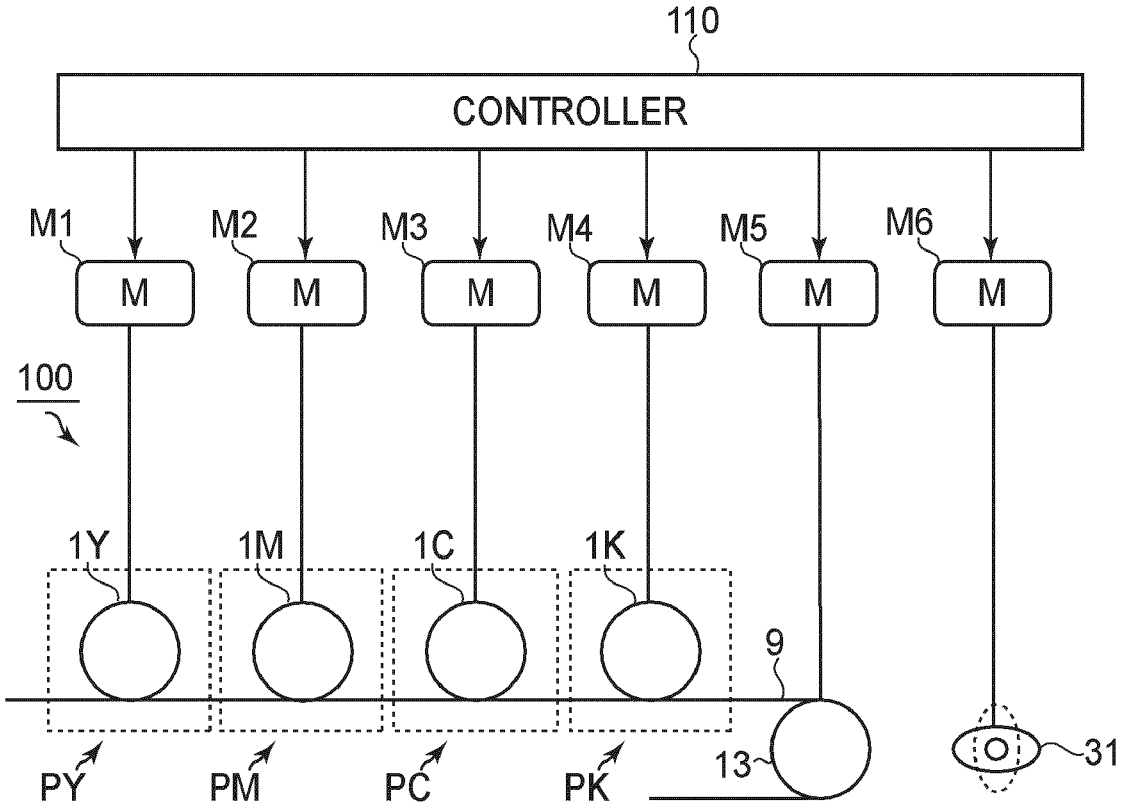
FIG. 4 is a schematic view for illustrating a driving system of an image forming apparatus.
Figure 5:
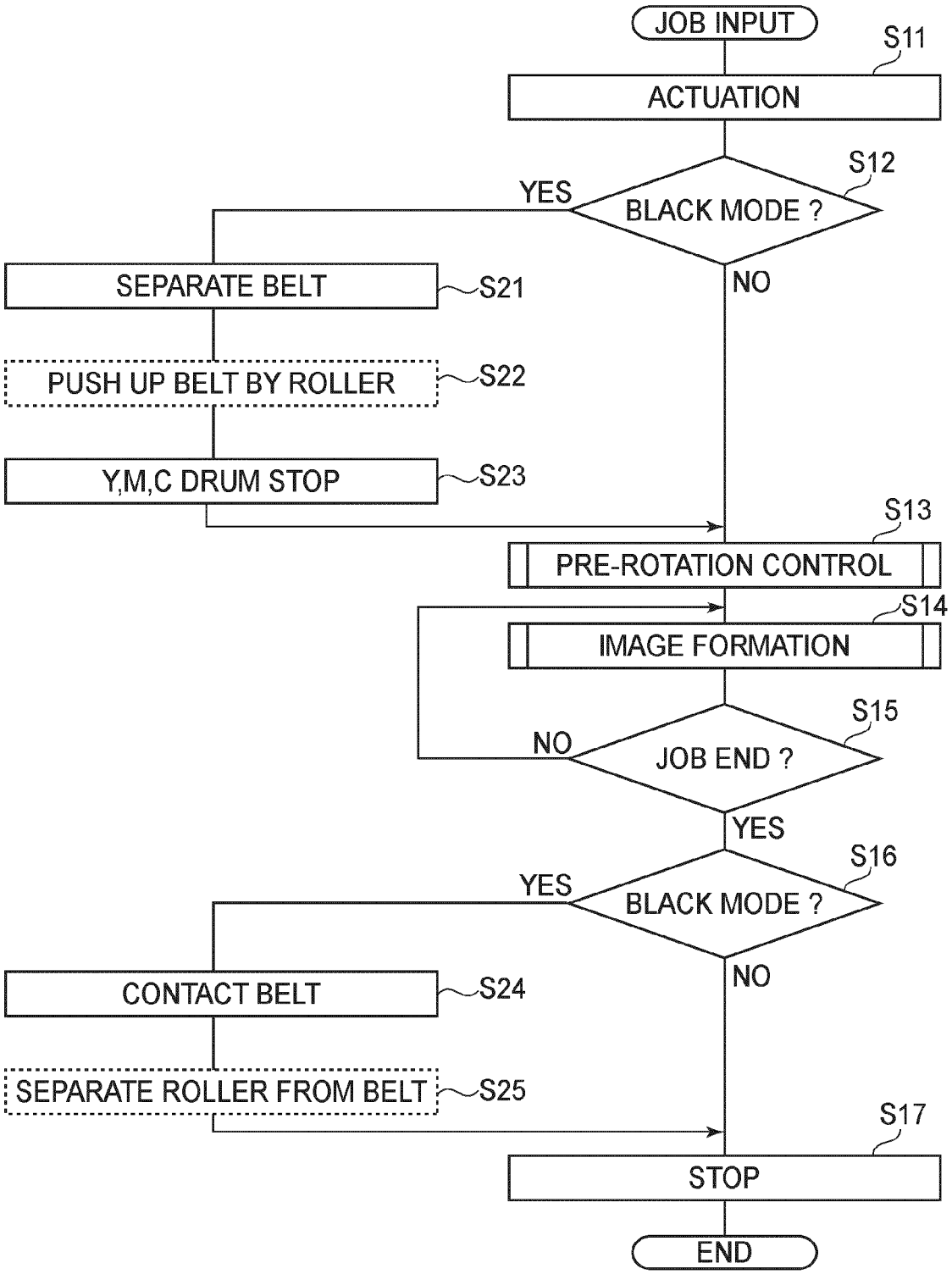
FIG. 5 is a flow chart of mode switching control.

FIG. 4 is a schematic view for illustrating a driving system for the image forming apparatus and FIG. 5 is a flow chart of mode switching control.

As shown in FIG. 4, the image forming apparatus 100 is driven by individual driving motors M1, M2, M3, M4, M5 and M6 for actuating the photosensitive drums 1Y, 1M, 1C and 1K, the driving roller 13, and the cam 31, respectively, which are controlled by the control portion 110.

The driving motors M1, M2, M3, M4 and M5 are individually speed-controlled by using a brushless DC motor so that the peripheral speeds of the photosensitive drums 1Y, 1M, 1C and 1K and the intermediary transfer belt 9 are kept at the above-described process speeds.

The driving motor M6 is reverse/stop-controlled depending on the full-color mode/the black monochromatic mode by using a gear motor.

As shown in FIG. 5 with reference to FIG. 4, when a job is inputted, the control portion 110 actuates the driving motors M1, M2, M3, M4 and M5 (S11).

The control portion 110 sets an image forming condition and a transfer condition by performing pre-rotation control (S13) in the case of the full-color mode (NO of S12) and repeats image formation (S14) until the job is completed (NO of S15).

When the job is completed (YES of S15), the control portion stops the driving motors M1, M2, M3, M4 and M5 (S17) since the image forming mode is not the black monochromatic mode (NO of S16).

In the case of the black monochromatic mode (YES of S12), the control portion 110 rotates the cam 31 by actuating the driving motor M6 to separate the intermediary transfer belt 9 from the photosensitive drums 1Y, 1M and 1C (S21). As a result, the stretching roller (15: FIG. 2) pushes up the intermediary transfer belt 9 to increase the angle of contact of the intermediary transfer belt 8 with the photosensitive drum 1K on the upstream side of the photosensitive drum 1K (S22).

The control portion stops the motors M1, M2 and M3 to stop the photosensitive drums 1Y, 1M and 1C which are not used for the image formation (S23).

When the job is completed (YES of S15), the control portion 110 actuates the driving motor M6 so as to be driven in the reverse direction to bring the intermediary transfer belt 9 into contact with the photosensitive drums 1Y, 1M and 1C (S24) since the image forming mode is black monochromatic mode (YES of S16). As a result, the stretching roller (15: FIG. 2) is lowered to a position in which the stretching roller is separated from the intermediary transfer belt 9 to decrease the angle of contact of the intermediary transfer belt 9 with the photosensitive drum 1K on the upstream side of the photosensitive drum 1K (S25).

The control portion 110 stops the driving motors M1, M2, M3, M4 and M5 to await a subsequent job in a state of the full-color mode (S17).

The control portion (110) sets an angle of contact (θ1) on the upstream side of the second transfer portion (TK) in a second mode so as to be larger than that in a first mode.

The control portion (110) separates an adjusting member (15) from the inner surface of the transfer belt (9) in the first mode.

<Angle of Contact of Transfer Belt>

Figure 6:
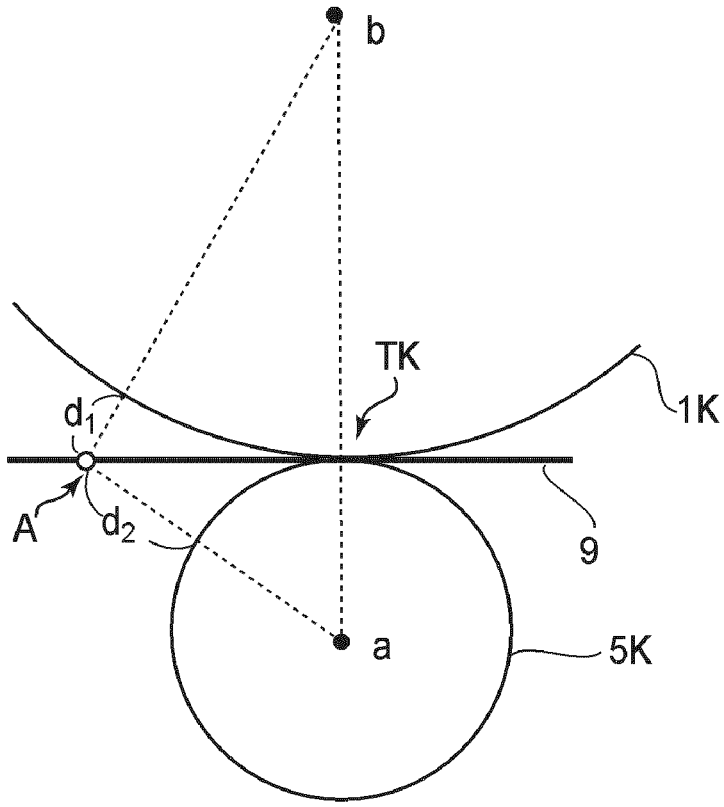
FIG. 6 is a schematic view for illustrating a state of contact of an intermediary transfer belt with a photosensitive drum in a full-color mode.
Figure 7:
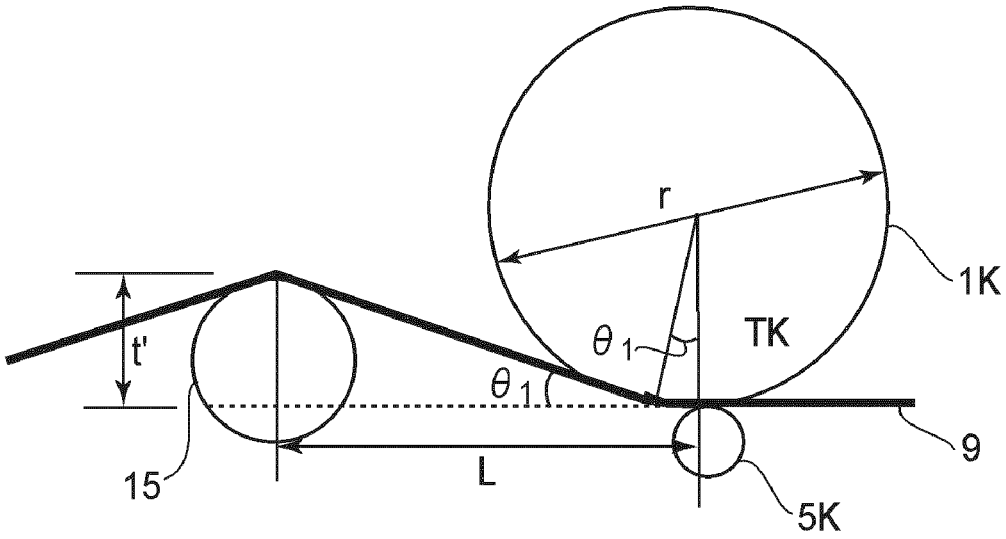
FIG. 7 is a schematic view for illustrating a state of contact (winding) of an intermediary transfer belt with (about) a photosensitive drum in a black monochromatic mode.

FIG. 6 is a schematic view for illustrating a contact (winding) state of the intermediary transfer belt with (about) the photosensitive drum in the full-color mode and FIG. 7 is a schematic view for illustrating a contact state of the intermediary transfer belt with the photosensitive drum in the black monochromatic mode.

As shown in FIG. 1, in the full-color mode, the stretching roller 15 is separated from the intermediary transfer belt 9, so that the intermediary transfer belt 9 is horizontally stretched between the photosensitive drum 1C and the photosensitive drum 1K.

As shown in FIG. 6, in the full-color mode, a black vertical line image (in a sub-scanning direction) with a line width of 300 μm was formed. In this case, when the vertical line image with the line width of 300 μm developed on the photosensitive drum 1K was primary-transferred at the primary transfer portion TK, the image caused an increase in line width up to 320 μm on the intermediary transfer belt 9. Since scattering of the toner is observed at a periphery of the vertical line image when the vertical line image on the intermediary transfer belt 9 is observed through an optical microscope, the increase in line width may be attributable to the toner scattering by the primary transfer.

As shown in FIG. 7, in the black monochromatic mode, the stretching roller 15 pushes up the inner surface of the intermediary transfer belt 9 to provide the angle of contact of the intermediary transfer belt 9 with the photosensitive drum 1K larger than that in the full-color mode.

Here, a distance between the primary transfer roller 5K and the stretching roller 15 is taken as L, a diameter of the photosensitive drum 1K is taken as r, and a push-up height of the intermediary transfer belt 9 when the stretching roller 15 pushes up the intermediary transfer belt 9 in the black monochromatic mode is taken as t'.

In this case, the angle of contact (θ1) of the intermediary transfer belt 9 with the photosensitive drum 1K added in the black monochromatic mode compared with the full-color mode is represented by the following equation:

$$\theta 1=\arctan(t'/L).$$

Further, a length of contact (l) of the intermediary transfer belt 9 with the photosensitive drum 1K formed by the added angle of contact (θ1) is represented by the following equation:

$$l=r\theta 1/2.$$

That is, in the black monochromatic mode, the stretching roller 15 pushes up the intermediary transfer belt 9 by the push-up height t', so that the intermediary transfer belt 9 is excessively wound about the photosensitive drum 1K by the length l on the upstream side of the primary transfer portion TK.

However, as described above, the primary transfer roller 5K is disposed downstream of a center line of the photosensitive drum 1K by 1.5 mm and is not moved, so that the position of the primary transfer portion TK through which a primary transfer current passes is not changed. For this reason, in the black monochromatic mode, compared with the full-color mode, the primary transfer roller 5K is placed in a downstreamly shifted state by the length of contact (l).

Then, an experiment in which the line width on the intermediary transfer belt 9 is measured in a state in which the push-up height t' (the length of contact (l)) of the intermediary transfer belt 9 is changed and the line image carried on the photosensitive drum 1K is primary-transferred onto the intermediary transfer belt 9 was conducted. The line image formed on the photosensitive drum 1K has a line width of 300 μm and a degree of scattering toner scattered at the periphery of the line image was evaluated by observing the line image on the intermediary transfer belt 9 through the optical microscope. An experimental result and an evaluation result are shown in Table 1.

TABLE 1

| *1 Height t (mm) | *2 Angle θ1 (deg.) | *3 Length l (mm) | *4 Width (μm) | Toner scattering |
|---|---|---|---|---|
| 0.00 | 0.00 | 0.000 | 320 | C |
| 1.02 | 2.86 | 0.749 | 320 | C |
| 1.56 | 4.29 | 1.123 | 313 | B |
| 2.10 | 5.71 | 1.495 | 311 | B |
| 2.65 | 7.13 | 1.865 | 308 | A |
| 3.22 | 8.53 | 2.233 | 304 | A |
| 3.50 | 9.93 | 2.599 | 302 | A |

*1: Push-up height
*2: Angle of contact
*3: Length of contact
*4: Line width

In Table 1 and also in Table 2 appearing hereinafter, the degree of toner scattering is evaluated as follows.

D: a level at which the toner scattering is clearly recognizable at the periphery of the line image by eyes and conspicuous image deterioration is found.

C: a level at which the toner scattering is recognizable at the periphery of the line image by eyes.

B: a level at which the toner scattering is barely recognizable by eyes and is clearly recognizable by observation through the optical microscope.

A: a level at which the toner scattering is not recognizable at all by eyes and is barely recognizable by observation through the optical microscope.

As shown in Table 1, with an increasing length of contact (l) on the upstream side of the primary transfer portion TK, the line width of the line image of the toner primary-transferred onto the intermediary transfer belt 9 came near to the line width of the toner image developed on the photosensitive drum 1K. Further, when the length of contact (l) is larger than 1.123 mm, a practically sufficient scattering-preventing effect was achieved.

That is, the length of contact (l) of the intermediary transfer belt (9) with the second image bearing member (1K) when the first image bearing member (1C) and the intermediary transfer belt (9) are separated from each other has an optimum range. Specifically, with respect to the movement direction of the intermediary transfer belt (9), when a length of the intermediary transfer belt (9) from an uppermost stream position in a contact area between the intermediary transfer belt (9) and the second image bearing member (1K) to a position in which the intermediary transfer belt (9) is nipped between the second image bearing member (1K) and the transfer member (5K) is taken as l, the optimum range is l>1.123 mm.

<Consideration of Scattering>

Figure 8:
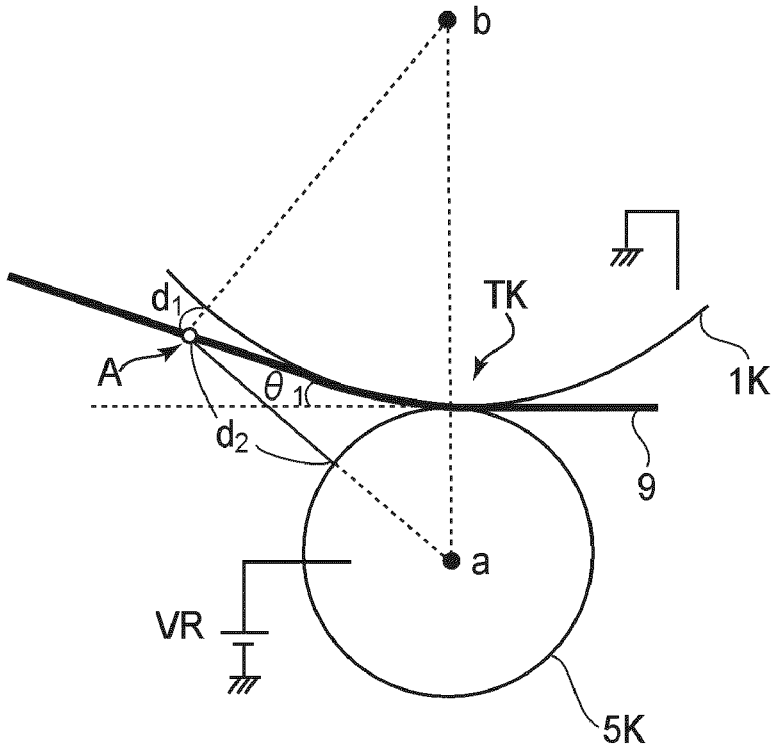
FIG. 8 is an enlarged view of a primary transfer portion in the black monochromatic mode.

FIG. 8 is an enlarged view of the primary transfer portion in the black monochromatic mode.

As described above with reference to FIG. 7, in the black monochromatic mode, the intermediary transfer belt 9 is wound about the photosensitive drum 1K by the angle of contact (θ1) more than in the full-color mode.

As shown in FIG. 8, a voltage VR is applied to the primary transfer roller 5K. Further, a minimum distance from point A on the intermediary transfer belt 9 to the surface of the photosensitive drum 1K is taken as d1 and a minimum distance from the point A to the surface of the primary transfer roller 5K is taken as d2.

Further, an electrostatic capacity between the intermediary transfer belt 9 and the photosensitive drum 1K is defined as C1 and a potential difference therebetween is defined as V1. Further, an electrostatic capacity between the intermediary transfer belt 9 and the primary transfer roller 5K is defined as C2 and a potential difference therebetween is defined as V2. In this case, the electrostatic capacities C1 and C2 and a potential VITB induced at the point A are represented by the following formulas:

$$C1 \propto \epsilon 0/d1,$$

$$C2 \propto \epsilon 0/d2, \text{ and}$$

$$VITB = VR - V2,$$

where ε0 represents a dielectric constant in a vacuum From these formulas, it is understood that the electrostatic constant C2 is decreased, when the distance d2 is increased, to increase the potential difference V2 between the intermediary transfer belt 9 and the primary transfer roller 5K to result in a small potential VITB of the intermediary transfer belt 9. Further, it is also understood that the potential difference V1 between the photosensitive drum 1K and the intermediary transfer belt 9 immediately before the point A reaches the primary transfer portion TK is decreased.

As a result, such a phenomenon that a blurred image is transferred onto the intermediary transfer belt 9 by flying of the toner from the photosensitive drum 1K onto the intermediary transfer belt 9 on the front side of the primary transfer portion TK is suppressed.

On the other hand, it is understood that the electrostatic constant C2 is increased, when the distance d2 is decreased, to decrease the potential difference V2 between the intermediary transfer belt 9 and the primary transfer roller 5K to result in a large potential VITB of the intermediary transfer belt 9. Further, it is also understood that the potential difference V1 between the photosensitive drum 1K and the intermediary transfer belt 9 immediately before the point A reaches the primary transfer portion TK is increased.

As a result, such a phenomenon that a blurred image is transferred onto the intermediary transfer belt 9 by flying of the toner from the photosensitive drum 1K onto the intermediary transfer belt 9 on the front side of the primary transfer portion TK becomes conspicuous.

Comparative Embodiment 1

Figure 9:
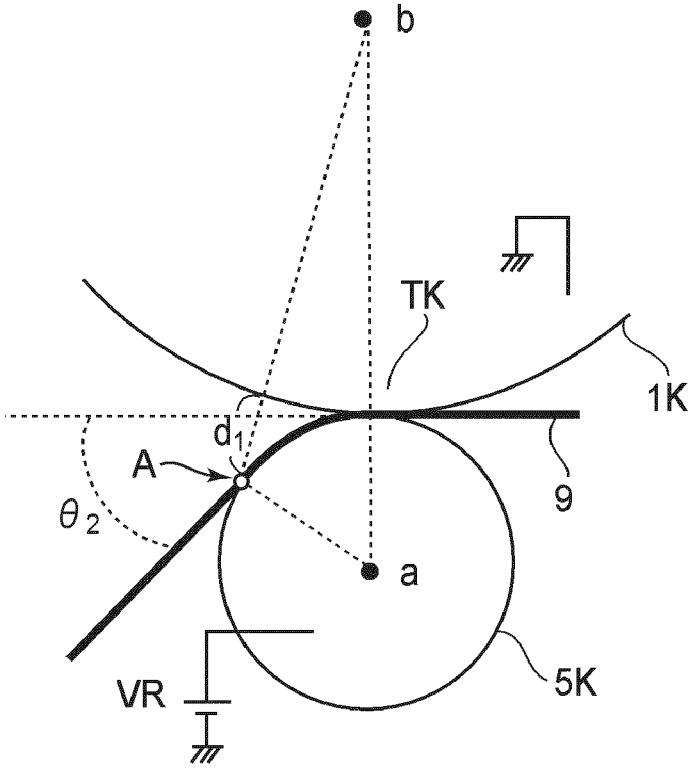
FIG. 9 is an enlarged view of the primary transfer portion in the case of no stretching roller.
Figure 10:
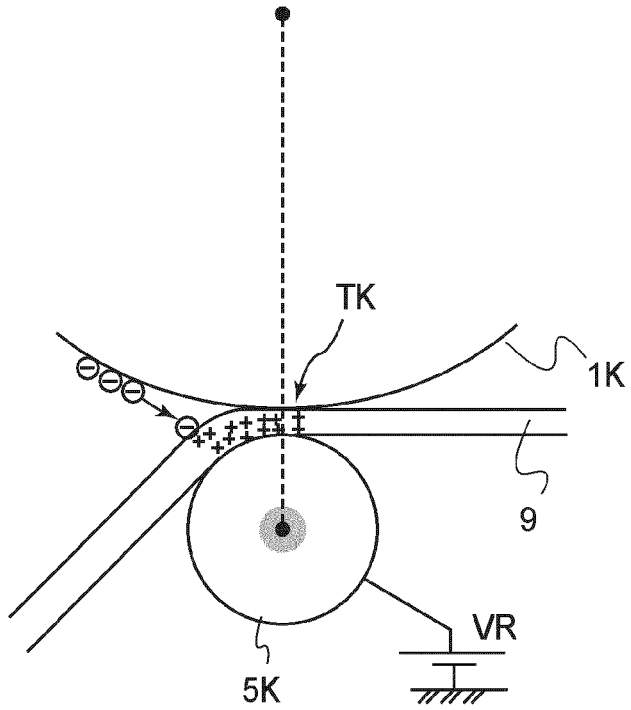
FIG. 10 is a schematic view for illustrating a charging state of an intermediary transfer belt which enters the primary transfer portion in the case of no stretching roller.

FIG. 9 is an enlarged view of the primary transfer portion in the case of no stretching roller and FIG. 10 is a schematic view for illustrating a charging state of the intermediary transfer belt entering the primary transfer portion in the case of no stretching roller.

As shown in FIG. 9, in the case where there is no stretching roller (15: FIG. 7) and the point A is located on the primary transfer roller 5K, a potential (VITB) of the point A is represented by the following equation:

$$VITB = VR$$

From this equation, it is understood that the potential difference V1 between the photosensitive drum 1K and the intermediary transfer belt 9 immediately before the point A reaches the primary transfer roller TK in this comparative embodiment is larger than that in First Embodiment described with reference to FIG. 6.

As a result, the phenomenon in which the blurred image is transferred onto the intermediary transfer belt 9 by flying of the toner on the photosensitive drum 1K onto the intermediary transfer belt 9 on the front side of the primary transfer portion TK.

As shown in FIG. 10, a transfer electric field extends toward the upstream side of the primary transfer portion TK to attract the toner having a small depositing force onto the photosensitive drum 1K, so that toner scattering (flying) onto the intermediary transfer belt 9 is caused to occur. Particularly, image deterioration due to the toner scattering on the upstream side of the primary transfer roller TK is noticeable in a thin line image such as a character image.

Further, the image formed in the black monochromatic mode includes a small and high-density character image at a high rate, so that the image deterioration due to the toner scattering is frequently recognized in the black monochromatic mode.

Compared with the yellow, magenta and cyan toners, the black toner has a high contrast with respect to a white recording material, so that the image deterioration due to the toner scattering is conspicuous.

Therefore, the number of occurrences of image defect is considerably decreased by increasing the length of contact of the intermediary transfer belt 9 with the photosensitive drum 1K in the specialized black monochromatic mode to suppress the image deterioration due to the toner scattering on the upstream side of the primary transfer portion TK. A similar effect is achieved with respect to not only a 5 character image or a line image with monochromatic two gradation levels but also a character/halftone image including a combination of a dot image and line image.

Scattering of a line image primary-transferred onto the intermediary transfer belt 9 was evaluated by 10 changing an angle of contact (θ2) of the intermediary transfer belt 9 with the primary transfer portion 5K with respect to several cases including Comparative Embodiment 1. The angle of contact (θ2) was changed by moving the stretching roller 15 in one direction 15 (downward direction) and formation and evaluation of the line image were performed in the same manner as in the experiment in First Embodiment. An experimental result and an evaluation result are shown in Table 2.

TABLE 2

| *1 Height t (mm) | *2 Angle θ2 (deg.) | *3 Width (μm) | Toner scattering |
|---|---|---|---|
| 0.00 | 0.00 | 320 | C |
| −1.02 | 2.86 | 321 | C |
| −1.56 | 4.29 | 324 | C |
| −2.10 | 5.71 | 330 | D |

TABLE 2-continued

| *1 Height t (mm) | *2 Angle θ2 (deg.) | *3 Width (μm) | Toner scattering |
|---|---|---|---|
| −2.65 | 7.13 | 342 | D |
| −3.22 | 8.53 | 358 | D |
| −3.50 | 9.93 | 370 | D |

*1: Push-up height
*2: Angle of contact
*3: Line width

As shown in FIG. 2, when the angle of contact (θ2) of the intermediary transfer belt 9 with the primary transfer roller 5K by pushing down the intermediary transfer belt 9 on the upstream side of the primary transfer portion TK, the line width is increased to result in a conspicuous scattering. When the angle of contact (θ2) is 5.71 degrees or more, the toner scattering is clearly recognizable by eyes at the periphery of the line image and thus the image deterioration is conspicuous.

As shown in FIG. 1, on the other hand, in the full-color mode, the stretching roller 15 is separated from the inner surface of the intermediary transfer belt 9 with reliability to be prevented from contacting the intermediary transfer belt 9.

When the stretching roller 15 is always placed in a state of contact with the inner surface of the intermediary transfer belt 9, an abrupt change in electric field in the intermediary transfer belt 9 is caused to occur on the stretching roller 15 in the full-color mode, so that the increase in line width of the line image and the scattering (blurring) of the toner image occur. As described in JP-A 2000-181184, particularly in the case where toner images of two or more colors are superposed and carried on the intermediary transfer belt 9, the increased line width of the line image and the transfer scattering are more conspicuous.

This is because the stretching roller 15 connected to the ground potential electrically discharges the intermediary transfer belt 9 instantaneously and negatively charges the intermediary transfer belt 9 to scatter the toner image carried on the intermediary transfer belt 9 over the intermediary transfer belt 9. Further, that is because when the intermediary transfer belt 9 causes the abrupt potential change during passing of the toner image on the intermediary transfer belt 9 through the stretching roller 15, electrical balance integrally constraining the toner image is disrupted and therefore the toner scatters over the periphery.

Further, as shown in FIG. 7, in an area in which the length of contact of the intermediary transfer belt 9 with the photosensitive drum 1K on the upstream side of the primary transfer portion TK, a part of the toner carried on the intermediary transfer belt 9 is moved to the photosensitive drum 1K. When a distance of movement of the toner carried on the photosensitive drum 1K and the toner carried on the intermediary transfer belt 9 in mixture is increased, the toner moved from the intermediary transfer belt 9 to the photosensitive drum 1K at the primary transfer portion TK is also increased in amount.

As a result, as shown in FIG. 1, a rate of movement of the yellow, magenta and cyan toners carried on the intermediary transfer belt 9 to the photosensitive drum 1K and then collection thereof by the cleaning device 6K is increased, so that a lowering in color image density and a change in color are liable to occur.

Therefore, by separating the stretching roller 15 from the intermediary transfer belt 9 in the specialized full-color mode, it is possible to prevent the image deterioration of the toner image primary-transferred at the upstream-side image forming stations PY, PM and PC.

Comparative Embodiment 2

Figure 11:
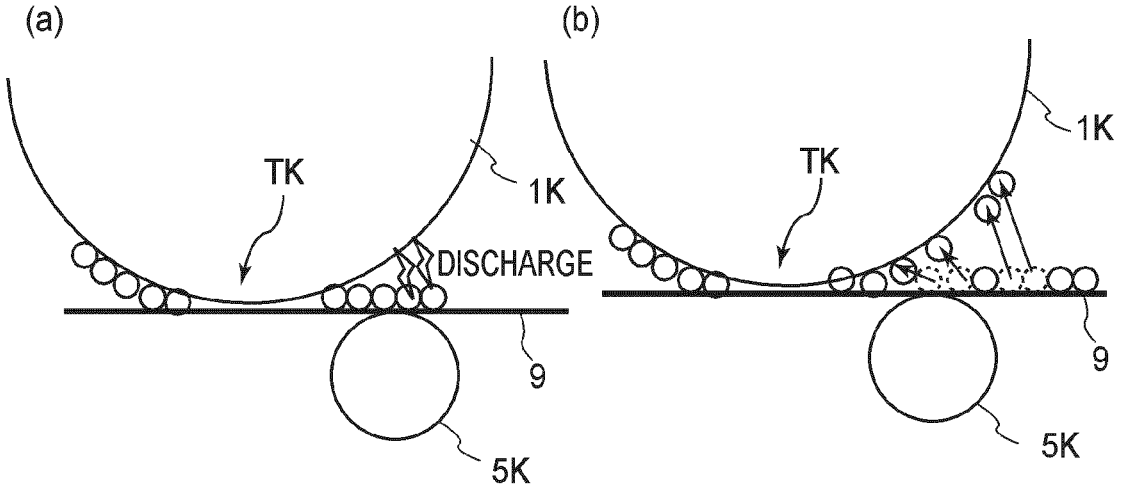
FIGS. 11(*a*) and 11(*b*) are schematic views for illustrating the case of moving a primary transfer roller toward a downstream side.
Figure 12:
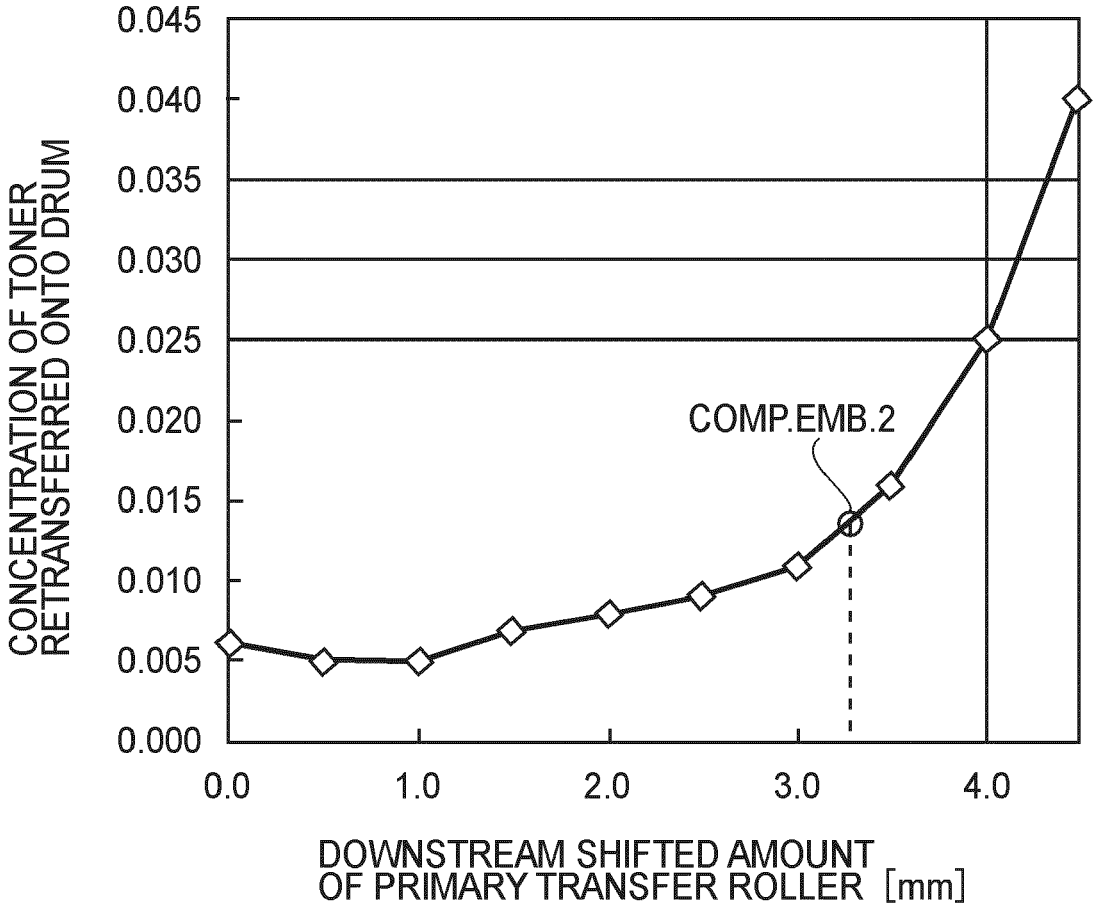
FIG. 12 is a graph showing a relationship between an amount of movement of the primary transfer roller and an amount of toner moved to the photosensitive drum.

FIG. 11 is a schematic view for illustrating the case where the primary transfer roller is moved to a downstream side and FIG. 12 is a graph showing a relationship between a amount of movement of the primary transfer roller and an amount of the toner moved to the photosensitive drum.

In First Embodiment, the length of contact of the intermediary transfer belt 9 with the photosensitive drum 1K in the black monochromatic mode is increased by raising the stretching roller. However, it is similarly possible to increase the length of contact of the intermediary transfer belt 9 with the photosensitive drum 1K by moving the primary transfer roller 5K to the downstream side with respect to the rotational direction of the intermediary transfer belt 9 (JR-A 2001-209234).

As described above with reference to Table 1, the evaluation of the toner scattering was "A" when the length of contact (l) of the intermediary transfer belt 9 with the photosensitive drum 1K was 1.865 mm. "A" is a level at which the toner scattering is not recognizable at all by eyes and is barely recognizable by observation through the optical microscope.

Then, Comparative Embodiment 2 in which the length of contact of the intermediary transfer belt 9 with the photosensitive drum 1K is increased by moving the primary transfer roller 5K to the downstream side by 1.865 mm with respect to the rotational direction of the intermediary transfer belt 9 will be considered.

As described above, the center of the primary transfer roller 5K is shifted from the center of the photosensitive drum 1K to the downstream side by 1.5 mm with respect to the rotational direction of the intermediary transfer belt 9. For this reason, in Comparative Embodiment 2, the primary transfer roller 5K is shifted to the downstream side by 1.865 mm+1.5 mm=about 3.3 mm while retaining the angle of contact (θ1=0) of the intermediary transfer belt 9 with the photosensitive drum 1K.

As shown in FIG. 1, in Comparative Embodiment 2, when the above-described line image is formed at the image forming station PK and is evaluated on the intermediary transfer belt 9, a substantially similar evaluation result is obtained.

However, in Comparative Embodiment 2, a rate of re-transfer of the toner images, which are formed at the image forming stations PY, PM and PK and are primary-transferred onto the intermediary transfer belt 9, onto the photosensitive drum 1K at the image forming station PK is increased. As a result, the lowering in color image density and the change in color are liable to occur.

As shown in FIG. 11, the re-transfer refers to such a phenomenon that the charge polarity of the toner carried on the intermediary transfer belt 9 is reversed by electric discharge generated on the downstream side of the primary transfer portion TK to cause transfer the toner onto the photosensitive drum 1K by a transfer voltage.

When the primary transfer roller 5K is shifted to the downstream side, the electric discharge is liable to occur on the downstream side of the primary transfer portion TK, so that a degree of the re-transfer is increased thereby to lower a transfer efficiency.

An amount of the toner re-transferred onto the photosensitive drum 1K was measured by changing the shifted amount of the primary transfer roller 5K with respect to the center of the photosensitive drum 1K in several embodiments including Comparative Embodiment 2. The toner amount was evaluated by collecting the toner image re-transferred onto the photosensitive drum 1K with an adhesive tape and subjecting the toner image to density measurement by a densitometer.

As shown in FIG. 12, the amount of the re-transferred toner is increased with an increasing shifted amount.

As shown in FIG. 1, in the image forming apparatus 100 of First Embodiment, the toner images pass through the primary transfer portions TM, TC and TK of the downstream-side photosensitive drums 1M, 1C and 1K in a state in which the toner images are formed on the intermediary transfer belt 9. That is, the yellow, magenta and cyan toner images in the full-color mode pass through the downstream-side primary transfer portions TM, TC and TK one or more time after being primary-transferred onto the intermediary transfer belt 9, thus causing the re-transfer each time.

For this reason, when the amount of the re-transferred toner is large, a color (image) density when the toner images pass through all the image forming stations PY, PM, PC and PK and are finally secondary-transferred and fixed on the recording material P cannot be sufficiently ensured.

In the constitution of Comparative Embodiment 2, the re-transferred toner amount is increased compared with the constitution of First Embodiment, so that the lowering in color image density and the change in color occur to lower the image quality. By effecting the image formation by excessively using the toner in consideration of an amount of toner removed by the re-transfer, the lowering in image quality can be suppressed to some extent but in this case, an amount of toner consumption is markedly increased.

Therefore, according to First Embodiment, it is possible to obtain a high-definition image such as a character image, a dot image, or a line image by suppressing the toner scattering, from the photosensitive drum onto the intermediary transfer belt, occurring on the upstream side of the primary transfer portion in the black monochromatic mode. At the same time, by suppressing the re-transfer in the full-color mode, it is possible to form a high-quality full-color image with less amount of toner consumption.

Second Embodiment

Figure 13:
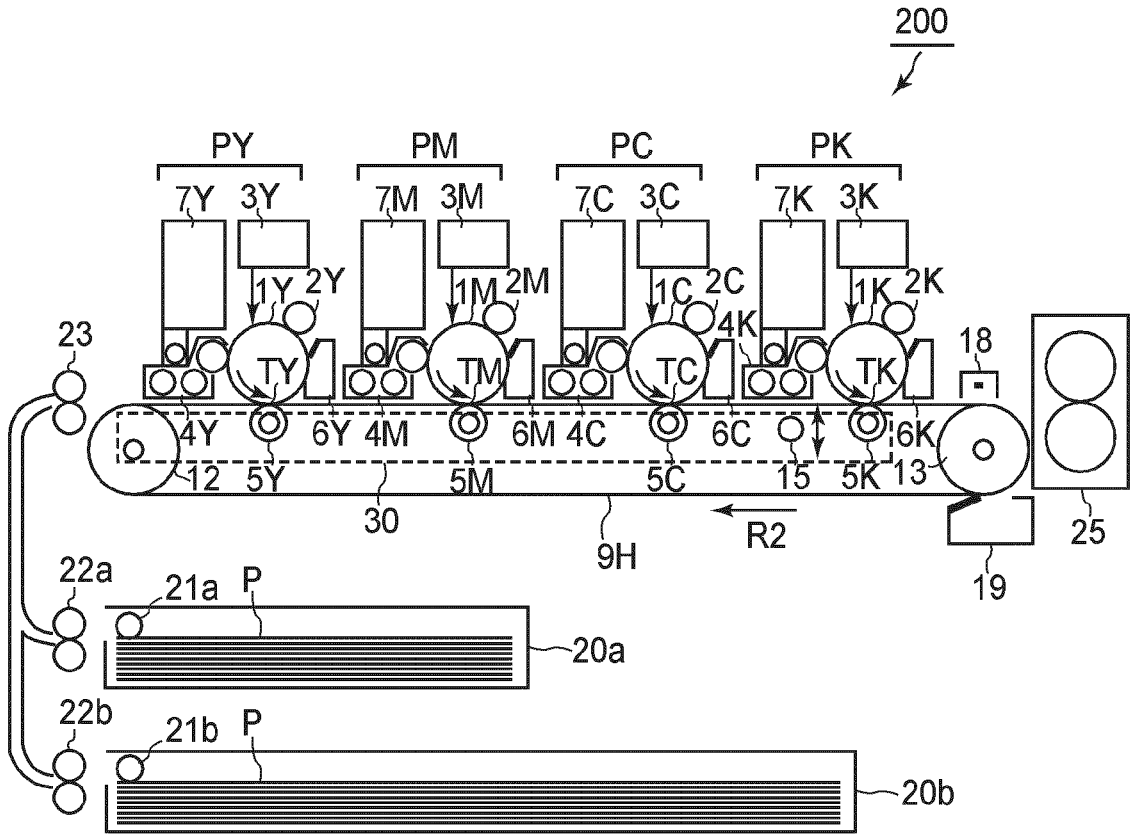
FIG. 13 is a schematic view for illustrating a constitution of an image forming apparatus of Second Embodiment.

FIG. 13 is a schematic view for illustrating a constitution of an image forming apparatus in Second Embodiment.

In FIG. 13, constituent members common to First Embodiment are represented by common reference numerals or symbols in FIG. 1, thus being omitted from redundant explanation.

As shown in FIG. 13, an image forming apparatus 200 of Second Embodiment is a tandem-type direct transfer type in which image forming stations PY, PM, PC and PK for yellow, cyan, magenta and black are arranged along a recording material conveying belt 9H.

At the image forming station PY, a yellow toner image is formed on a photosensitive drum 1Y and is directly-transferred onto a recording material P carried on the recording material conveying belt 9H. At the image forming station PM, a magenta toner image is formed on a photosensitive drum 1M and is directly-transferred onto the recording material P by being superposed on the yellow toner image. At image forming stations PC and PK, a cyan toner image and a black toner image are formed on a photosensitive drum 1C and a photosensitive drum 1K, respectively, and are directly transferred onto the recording material P by being superposed on the yellow and magenta toner images.

The recording material P which is carried on the recording material conveying belt 9H and on which the four color toner images are directly transferred in a superposition manner is electrically discharged by a separation charger 18 to be separated from the recording material conveying belt 9H.

The recording material P separated from the recording material conveying belt is delivered to a fixing device 25 and is subjected to heat pressing, so that a full-color image is fixed on a surface of the recording material P.

In the image forming apparatus 200, in the black monochromatic mode, the contact-separation mechanism 30 is rotationally moved about the transfer roller 5K to separate the recording material conveying belt 9H from the photosensitive drums 1Y, 1M and 1C. At this time, the stretching roller 15 is moved upwardly din interrelation with the contact-separation mechanism 30 to increase the angle of contact (θ1: FIG. 7) of the recording material conveying belt 9H with the photosensitive drum 1K compared with the case of the full-color mode.

As a result, according to the present invention, it is possible to improve a quality of an image formed in the black monochromatic mode even when the transfer member is not moved.

Further, in the above-described embodiments, the plurality of image bearing members is employed in the constitutions but the present invention is applicable to even such a constitution that different color toner images are formable on a single (one) image bearing member and are transferred onto an intermediary transfer belt in a superposition manner to form a color image. Specifically, in the black monochromatic mode, such a constitution that a surface of the intermediary transfer belt located on the upstream side of the transfer portion, at which the toner image is transferred from the image bearing member onto the intermediary transfer belt, with respect to the rotational direction of the intermediary transfer belt is moved upwardly to contact the image bearing member is employed. Further, in the full-color mode, such a constitution that the upward movement operation of the belt surface is not performed is employed. By employing such a constitution, it is possible to improve the quality of the image formed in the black monochromatic mode even when the transfer member is not moved.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 316495/2007 filed Dec. 7, 2007, which is hereby incorporated by reference.

What is claimed is:

1. An image forming apparatus comprising:

a first image bearing member;

a second image bearing member;

a rotatable belt member, contactable to said first image bearing member and to said second image bearing member, for carrying a toner image, wherein said first image bearing member is disposed downstream of said second image bearing member with respect to a rotational direction of said belt member;

a first transfer member for transferring a toner image from said first image bearing member onto said belt member;

a second transfer member for transferring a toner image from said second image bearing member onto said belt member;

a movable portion for separating said belt member from said second image bearing member in a state in which said first image bearing member and said belt member contact each other; and a belt surface moving portion for moving a surface of said belt member between said first image bearing member and said second image bearing member so that a contact area between said first image bearing member and said belt member, when said belt member and said second image bearing member are separated from each other, is larger than that when said first image bearing member and said second image bearing member contact said belt member.

2. An apparatus according to claim 1, wherein a position of said first transfer member relative to said first image bearing member with respect to the rotational direction of said belt member is fixed.

3. An apparatus according to claim 1, wherein said belt surface moving portion includes a contact-separation member, which contacts said belt member when said belt member and said second image bearing member are separated from each other, and is separated from said belt member when said first image bearing member and said second image bearing member contact said belt member.

4. An apparatus according to claim 3, wherein said contact-separation member is grounded.

5. An apparatus according to claim 1, wherein said first image bearing member and said second image bearing member are located at adjacent positions.

6. An image forming apparatus comprising:

a first image bearing member;

a second image bearing member;

a rotatable belt member, contactable to said first image bearing member and to said second image bearing member, for carrying a recording material, wherein said first image bearing member is disposed downstream of said second image bearing member with respect to a rotational direction of said belt member;

a first transfer member for transferring a toner image from said first image bearing member onto the recording material;

a second transfer member for transferring a toner image from said second image bearing member onto the recording material;

a movable portion for separating said belt member from said second image bearing member in a state in which said first image bearing member and said belt member contact each other; and a belt surface moving portion for moving a surface of said belt member between said first image bearing member and said second image bearing member so that a contact area between said first image bearing member and said belt member, when said belt member and said second image bearing member are separated from each other, is larger than that when said first image bearing member and said second image bearing member contact said belt member.

7. An apparatus according to claim 6, wherein a position of said first transfer member relative to said first image bearing member with respect to the rotational direction of said belt member is fixed.

8. An apparatus according to claim 6, wherein said belt surface moving portion includes a contact-separation member, which contacts said belt member when said belt member and said second image bearing member are separated from each other, and is separated from said belt member when said first image bearing member and said second image bearing member contact said belt member.

9. An apparatus according to claim 8, wherein said contact-separation member is grounded.

10. An apparatus according to claim 6, wherein said first image bearing member and said second image bearing member are located at adjacent positions.

11. An image forming apparatus comprising:

an image bearing member;

a rotatable belt member, contactable to said image bearing member, for carrying a toner image;

a transfer member for forming a transfer portion at which the toner image is transferred from said image bearing member onto said belt member;

a selecting portion for selecting a color image forming mode for forming a color image on a recording material by forming a plurality of color toner images on said belt member and a monochromatic image forming mode for forming a monochromatic toner image on the recording material by forming the monochromatic toner image on said belt member; and a belt surface moving portion for moving a belt surface of said belt member located upstream of said transfer portion with respect to a rotational direction of said belt member so that a contact area between said image bearing member and said belt member, when the monochromatic image forming mode is selected, is larger than that when the color image forming mode is selected.

12. An apparatus according to claim 11, wherein said image forming apparatus further comprises:

a second image bearing member located upstream of said image bearing member with respect to the rotational direction of said belt member, and wherein said belt member contacts said second image bearing member when said selecting portion selects the color image forming mode and separates from said second image bearing member when said selecting portion selects the monochromatic image forming mode.

13. An apparatus according to claim 11, wherein a position of said transfer member relative to said image bearing member with respect to the rotational direction of said belt member is fixed.

14. An apparatus according to claim 12, wherein said belt surface moving portion includes a contact-separation member, which contacts said belt member when said belt member and said second image bearing member are separated from each other, and is separated from said belt member when said image bearing member and said second image bearing member contact said belt member.

15. An apparatus according to claim 14, wherein said contact-separation member is grounded.

16. An apparatus according to claim 11, wherein said image bearing member and said second image bearing member are located at adjacent positions.

* * * * *